US010684058B2

(12) United States Patent
Tao et al.

(10) Patent No.: US 10,684,058 B2
(45) Date of Patent: Jun. 16, 2020

(54) REFRIGERATOR

(71) Applicants: QINGDAO HAIER REFRIGERATOR CO., LTD., Qingdao, Shandong Province (CN); QINGDAO HAIER JOINT STOCK CO., LTD., Qingdao, Shandong Province (CN)

(72) Inventors: Haibo Tao, Qingdao (CN); Feifei Qi, Qingdao (CN); Lisheng Ji, Qingdao (CN); Jianru Liu, Qingdao (CN)

(73) Assignees: QINGDAO HAIER REFRIGERATOR CO., LTD., Qingdao, Shandong Province (CN); QINGDAO HAIER JOINT STOCK CO., LTD., Qingdao, Shandong Province (CN)

( * ) Notice: Subject to any disclaimer, the term of this patent is extended or adjusted under 35 U.S.C. 154(b) by 283 days.

(21) Appl. No.: 15/547,773

(22) PCT Filed: Jun. 17, 2016

(86) PCT No.: PCT/CN2016/086185
§ 371 (c)(1),
(2) Date: Jul. 31, 2017

(87) PCT Pub. No.: WO2017/032149
PCT Pub. Date: Mar. 2, 2017

(65) Prior Publication Data

US 2018/0017312 A1 Jan. 18, 2018

(30) Foreign Application Priority Data

Aug. 26, 2015 (CN) ..... 2015 1 0531589

(51) Int. Cl.
*F25D 17/04* (2006.01)
*F25D 17/06* (2006.01)
*F25D 11/02* (2006.01)

(52) U.S. Cl.
CPC ..... *F25D 17/065* (2013.01); *F25D 11/02* (2013.01); *F25D 17/045* (2013.01);
(Continued)

(58) Field of Classification Search
CPC ..... F25D 17/06; F25D 17/04; F25D 17/065; F25D 17/045; F25D 11/02; F25D 17/042;
(Continued)

(56) References Cited

U.S. PATENT DOCUMENTS 5,765,388 A * 6/1998 Jeon ..... F25D 17/065 62/408
9,341,402 B1 * 5/2016 Loudermilk ..... F25C 5/182
2003/0024254 A1 * 2/2003 Yoshida ..... F25D 17/042 62/78

FOREIGN PATENT DOCUMENTS

CN 1757999 A 4/2006
CN 1880893 * 12/2006
(Continued)

*Primary Examiner* — Vivek K Shirsat
*Assistant Examiner* — Ko-Wei Lin
(74) *Attorney, Agent, or Firm* — Cheng-Ju Chiang

(57) ABSTRACT

The invention provides a refrigerator, comprising a top air passage provided at a top wall of the storage compartment and connected with the refrigeration air passage to receive refrigeration air therefrom; an air guiding pipe comprising an air inlet end connected with the top air passage, an air outlet end for supplying air to the storage compartment, and an air outlet opening downwards; and a first air supply device configured to cause air flow to enter the air guiding pipe via the top air passage, such that the refrigeration air flowing into the top air passage from the refrigeration air
(Continued)

passage is blown downwards in a concentrated manner via the air guiding pipe.

8 Claims, 3 Drawing Sheets

(52) U.S. Cl.
CPC ..... *F25D 2317/0651* (2013.01); *F25D 2317/0665* (2013.01); *F25D 2317/0666* (2013.01); *F25D 2400/28* (2013.01); *F25D 2400/30* (2013.01)

(58) Field of Classification Search
CPC .. F25D 17/062; F25D 17/067; F25D 2317/06; F25D 2317/063; F25D 2317/066; F25D 2317/0664; F25D 2317/0665; F25D 2317/0666; F25D 2317/0667
USPC ..... 62/441, 447
See application file for complete search history.

(56) References Cited

FOREIGN PATENT DOCUMENTS

| | | | |
|---|---|---|---|
| CN | 1880893 | A | 12/2006 |
| CN | 101435646 | A | 5/2009 |
| CN | 105066554 | A | 11/2015 |
| CN | 105066563 | A | 11/2015 |
| CN | 204923641 | U | 12/2015 |
| CN | 205002481 | U | 1/2016 |
| KR | 2003-0064552 | A | 8/2003 |

* cited by examiner

REFRIGERATOR

CROSS REFERENCE TO RELATED APPLICATIONS

The present application is a 35 U.S.C. § 371 National Phase conversion of International (PCT) Patent Application No. PCT/CN2016/086185, filed on Jun. 17, 2016, which claims benefit of Chinese patent application No. 2015105321589.2 filed on Aug. 26, 2015, the disclosure of which is incorporated by reference herein. The PCT International Patent Application was filed and published in Chinese.

TECHNICAL FIELD

The present invention is related to the field of freezing and refrigeration technologies, and more particularly, to a refrigerator.

BACKGROUND

Air-cooled refrigerators can maintain the freshness of food, extend food storage time and improve food safety, so they become essential home appliances. However, in current air-cooled refrigerators, usually the air supply passage is arranged at the rear part of a storage compartment. After cooled air is blown, it sinks. As a result, the temperature at the front part of the storage compartment is relatively high, while the temperature at the rear part thereof is relatively low, causing uneven temperatures. The front part of the storage compartment is close to the door and heat leak can easily occur. Accordingly, the temperature at the front part of the storage compartment will be even higher, which is unfavorable for storing food. In particular, for articles requiring quick refrigeration, such as beverages or water melons just bought, existing refrigerators need a long time to allow these articles to reach a user-desired temperature, so that users cannot enjoy these articles in time.

SUMMARY

This invention aims to overcome at least one defect of existing refrigerators, and provides a novel refrigerator. The refrigerator can quickly cool some articles put therein and quickly allow them to reach a user-desired temperature.

Accordingly, this invention provides a refrigerator, comprising: a storage compartment and a refrigeration air passage configured to supply refrigeration air. In particular, the refrigerator further comprises: a top air passage provided at a top wall of the storage compartment and connected with the refrigeration air passage to receive refrigeration air therefrom; an air guiding pipe comprising an air inlet end connected with the top air passage and an air outlet end for supplying air to the storage compartment, wherein the air guiding pipe is bent downwards to the air outlet end after horizontally extending for a predetermined length from the air inlet end to form an air outlet opening downwards; and a first air supply device configured to cause air flow to enter the air guiding pipe via the top air passage, such that the refrigeration air flowing into the top air passage from the refrigeration air passage is blown downwards in a concentrated manner via the air guiding pipe.

Optionally, the refrigerator further comprises a second air supply device configured to cause the refrigeration air to enter the refrigeration air passage.

Optionally, an air inlet of the air inlet end of the air guiding pipe communicates and is connected with an air outlet of the top air passage, and the first air supply device is arranged inside the top air passage and/or the air guiding pipe; or an air inlet of the first air supply device communicates and is connected with the air outlet of the top air passage, and an air outlet of the first air supply device communicates and is connected with the air inlet of the air inlet end of the air guiding pipe.

Optionally, the first air supply device is a centrifugal blower or a centrifugal impeller provided at the air outlet of the top air passage.

Optionally, the first air supply device is configured to suck the refrigeration air entering the top air passage from a top part of the top air passage, and horizontally blow at least part of the refrigeration air to the air guiding pipe.

Optionally, the top air passage is longitudinally arranged in a corner at the top of the storage compartment, which extends longitudinally, a rear end of the top air passage is formed with an air inlet communicating with the refrigeration air passage, and a front end of the top air passage is formed with an air outlet for supplying air to the air guiding pipe.

Optionally, a horizontal portion of the air guiding pipe extends transversely; and an air outlet of the air guiding pipe faces a vertical downside direction, and is provided at the transverse center of the storage compartment.

Optionally, the refrigeration air passage is arranged at a rear wall of the storage compartment, and comprises a first air outlet communicating with the storage compartment and a second air outlet communicating with the top air passage.

Optionally, the refrigeration air passage comprises a general refrigeration air passage, and a first branch and a second branch respectively communicating with the general refrigeration air passage; at least one first air outlet is provided on the first branch; and the second air outlet is provided on the second branch.

Optionally, the refrigerator further comprises an air passage switching device configured to controllably close or open the first branch and/or the second branch.

As the refrigerator of this invention includes a top air passage, an air guiding pipe and a first air supply device, the refrigeration air from the refrigeration air passage can be blown downwards in a concentrated manner, so that the refrigeration air can be supplied to an area below the air outlet of the air guiding pipe inside the storage compartment in a concentrated manner. As a result, a local area of the storage compartment can be cooled quickly, and the articles put below the air outlet of the air guiding pipe can be cooled quickly.

Further, using the refrigerator of this invention, as the refrigerator includes an air passage switching device, all the refrigeration output in the refrigerator can be blown to a certain area in a concentrated manner, so that food placed in that area such as beverages, water, meat or the like can be cooled quickly, achieving good preservation and freshness-retaining effects for food and meeting users' demand for prompt use.

The above and other objects, advantages and features of the invention will be understood by those skilled in the art more clearly with reference to the detailed description of the embodiments of this invention below with reference to the accompanying drawings.

BRIEF DESCRIPTION OF THE DRAWINGS

The followings will describe some embodiments of this invention in detail in an exemplary rather than restrictive manner with reference to the accompanying drawings. The same reference signs in the drawings represent the same or similar parts. Those skilled in the art shall understand that these drawings are only schematic ones of this invention, and may not be necessarily drawn according to the scales. In the drawings.

DETAILED DESCRIPTION

Figure 1:
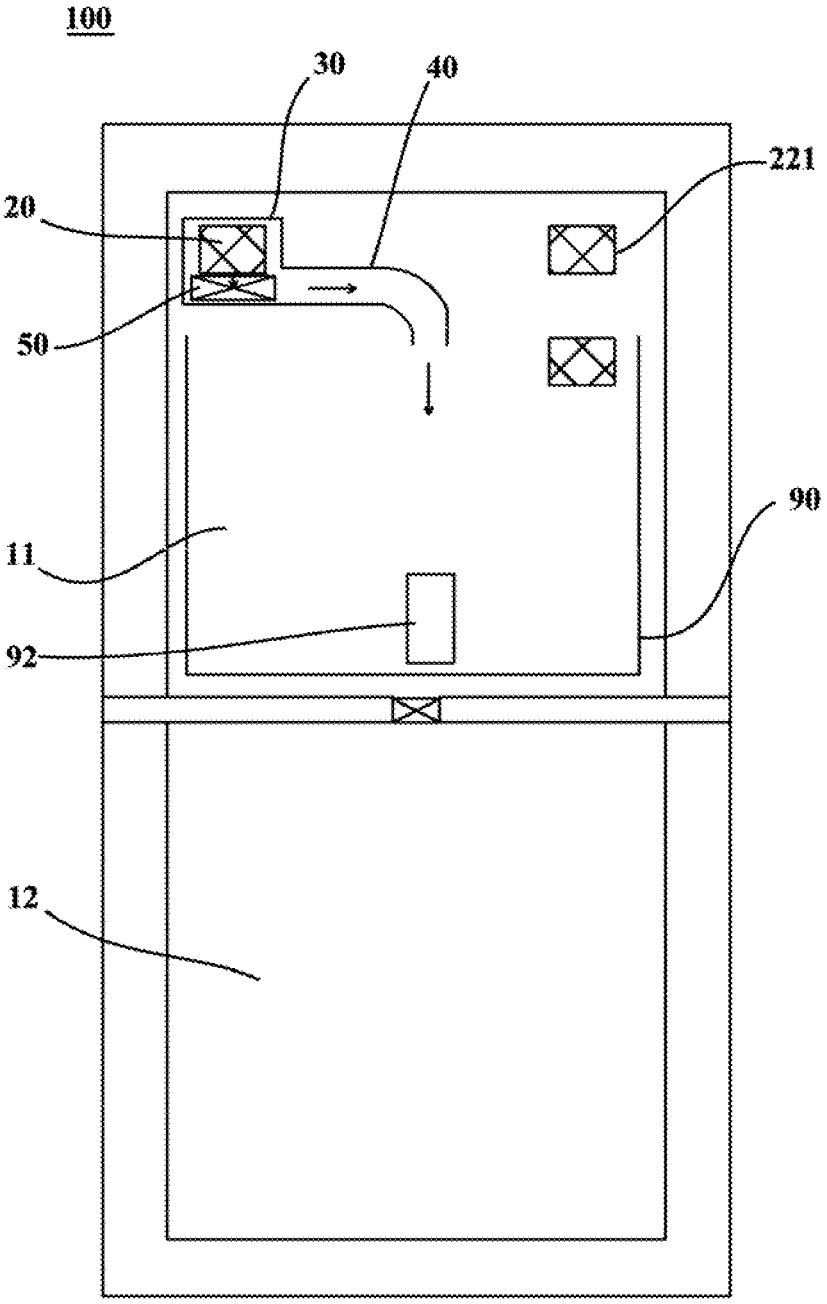
FIG. 1 is a schematic front view of a refrigerator according to an embodiment of this invention.

FIG. 1 is a schematic front view of a refrigerator 100 according to an embodiment of this invention. As shown in FIG. 1, the embodiment of this invention provides a refrigerator 100. The refrigerator 100 may typically comprise a storage compartment 11 for storing food, a refrigeration air passage 20 for providing and/or supplying refrigeration air to the storage compartment 11, and a door 14 for closing the storage compartment 11. In particular, the refrigerator 100 may further comprise: a top air passage 30, an air guiding pipe 40 and a first air supply device 50. The top air passage 30 is provided at a top wall of the storage compartment 11 and connected with the refrigeration air passage 20 to receive refrigeration air therefrom. The air guiding pipe 40 comprises an air inlet end connected with the top air passage 30 and an air outlet end for supplying air to the storage compartment 11. Preferably, the air guiding pipe 40 is bent downwards to the air outlet end after horizontally extending for a predetermined length from the air inlet end to form an air outlet opening downwards. The first air supply device 50 is configured to cause air flow to enter the air guiding pipe 40 via the top air passage 30, such that the refrigeration air flowing into the top air passage 30 from the refrigeration air passage 20 is blown downwards in a concentrated manner via the air guiding pipe 40, and the articles 92 put below the air outlet of the air guiding pipe 40 can be cooled quickly.

In some embodiments of this invention, an air inlet of the air inlet end of the air guiding pipe 40 communicates and is connected with an air outlet of the top air passage 30, and the first air supply device 50 is arranged inside the top air passage 30 and/or the air guiding pipe 40. For example, the first air supply device 50 may be realized as a centrifugal impeller or an axial blower provided at the air outlet of the top air passage 30. In some embodiments of this invention, an air inlet of the first air supply device 50 communicates and is connected with the air outlet of the top air passage 30, and an air outlet of the first air supply device 50 communicates and is connected with the air inlet of the air inlet end of the air guiding pipe 40. For example, the first air supply device 50 may be a centrifugal blower.

In some embodiments of this invention, the refrigeration air passage 20 may be able to supply refrigeration air to the top air passage 30 or to the storage compartment 11 directly. Specifically, the refrigeration air passage 20 may be arranged at a rear wall of the storage compartment 11, and may comprise at least one first air outlet 221 communicating with the storage compartment 11 and a second air outlet 231 communicating with the top air passage 30.

Figure 2:
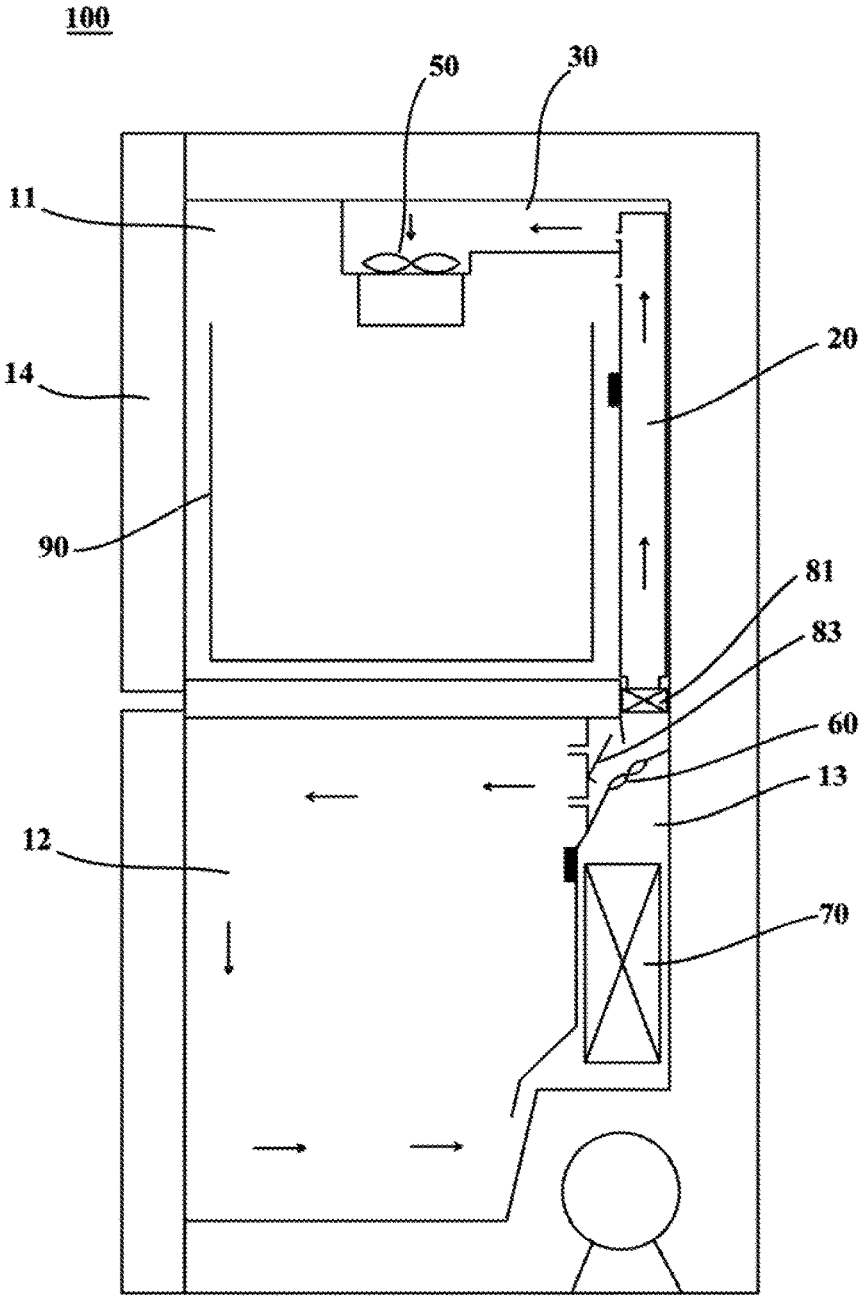
FIG. 2 is a schematic left view of a refrigerator according to an embodiment of this invention.

FIG. 2 is a schematic left view of a refrigerator 100 according to an embodiment of this invention. As shown in FIG. 2, the top air passage 30 extends longitudinally, a rear end of the top air passage 30 is formed with an air inlet communicating with the refrigeration air passage 20, and a front end of the top air passage is formed with an air outlet for supplying air to the air guiding pipe 40. For example, the refrigerator 100 may comprise a top air passage cover plate mounted at an inner surface of the top wall of the storage compartment 11 to form the top air passage 30. The top air passage cover plate may comprise a cover plate portion and a projecting web portion projecting downwards and located at the front end of the cover plate portion, and the first air supply device 50 may be provided inside the projecting web portion. To reasonably arrange the space inside the storage compartment 11, the top air passage 30 may be arranged in a corner at the top of the storage compartment 11, which extends longitudinally.

Further, as shown in FIG. 1, the horizontal portion of the air guiding pipe 40 may extend transversely. An air outlet of the air guiding pipe 40 faces a vertical downside direction, and is provided at the transverse center of the storage compartment 11 so that the user can conveniently place articles requiring quick refrigeration. In this embodiment, the first air supply device 50 is a centrifugal fan or a centrifugal impeller, and is configured to suck refrigeration air flowing into the top air passage 30 from the top of the top air passage and horizontally blow at least part of the refrigeration air to the air guiding pipe 40.

In some embodiments of this invention, the refrigerator 100 may further comprise a second air supply device 60 configured to cause the refrigeration air to enter the refrigeration air passage 20. The second air supply device 60 may provide power for the part or all of the air in the storage compartment 11 of the refrigerator 100 such that the part or all of the air flows out of the storage compartment 11 and enters the refrigeration air passage 20 after being cooled. For example, the refrigerator 100 may further comprise a cooling chamber 13, a cooling device 70 and a return air passage. The cooling chamber 13 is provided with an air outlet connected with the refrigeration air passage 20. The cooling device 70 may be an evaporator of a compression refrigeration system, and may be arranged inside the cooling chamber 13 to cool the air passing the cooling chamber. The return air passage connects a lower space of the storage compartment 11 and the cooling chamber 13. The second air supply device 60 may be arranged at the air inlet of the cooling chamber 13, and may be configured such that a part or all of the air in the storage compartment 11 enters the cooling chamber 13 via the return air passage and enters the refrigeration air passage 20 after being cooled by the cooling device 70.

Figure 3:
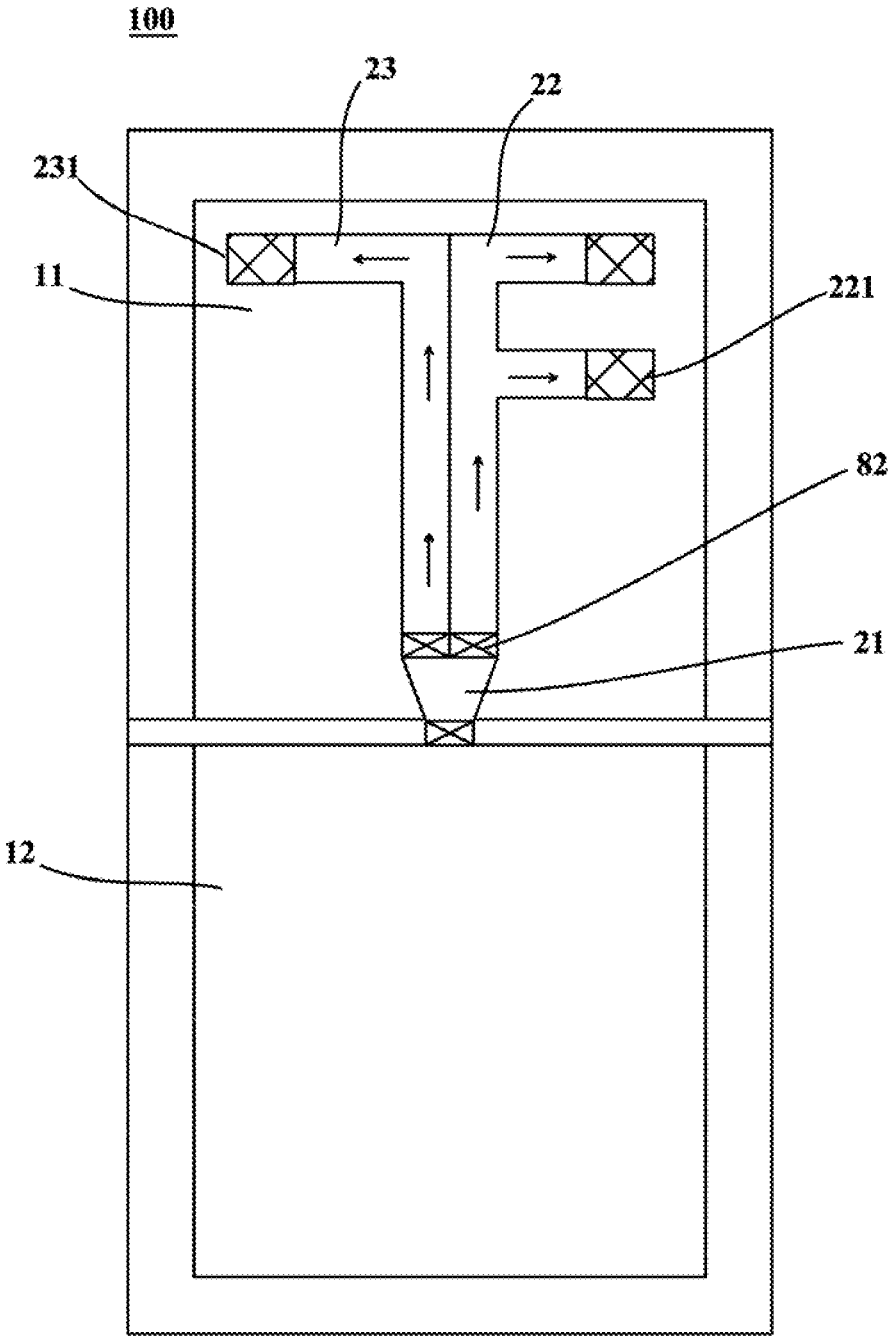
FIG. 3 is a schematic local view of a refrigerator according to an embodiment of this invention.

In some embodiments of this invention, to facilitate concentrated air supply, as shown in FIG. 3, the refrigeration air passage 20 comprises a general refrigeration air passage 21, and a first branch 22 and a second branch 23 respectively communicating with the general refrigeration air passage 21. At least one first air outlet 221 is provided on the first branch 22; and the second air outlet 231 is provided on the second branch 23. The air outlet of the cooling chamber 13 may communicate with the general refrigeration air passage 21. Preferably, the refrigerator 100 may further comprise an air passage switching device configured to controllably close or open the first branch 22 and/or the second branch 23. Specifically, the air passage switching device may comprise a first air door 81 and a second air door 82. The first air door 81 may be arranged at the air inlet of the general refrigeration air passage 21 to control the opening and closing of the general refrigeration air passage 21. The second air door 82 may be arranged at the air inlets of the first and second branches 22, 23 to close the second branch 23 when opening the first branch 22 and close the first branch 22 when opening the second branch 23. When supplying air in a concentrated manner, the first and second air supply devices 50, 60 may be started, and the first air door 81 and the second air door 82 may be opened at the same time, so that all the refrigeration air is blown downwards from the air outlet of the air guiding pipe 40.

In some embodiments of this invention, to facilitate picking and placing of articles, the refrigerator 100 may further comprise a drawer 90 for receiving the articles 92, such as beef, water melons and beverages. The drawer 90 can be operably inserted into the storage compartment 11 and pulled out of the same. In other words, the drawer 90 is installed inside the storage compartment 11. Optionally, a lower part of the rear wall of the drawer 90 comprises ventilation holes, so that the air flow flowing out of the air outlet of the air guiding pipe 40 can easily flow out of the drawer 90 via the ventilation holes of the drawer 90 after exchanging heat with the articles inside the drawer 90, and enter the return air passage for circulation.

In some embodiments of this invention, as shown in FIG. 2, the refrigerator 100 may further comprise another storage compartment 12, which may be arranged blow the storage compartment 11. For example, the storage compartment 11 may be a refrigeration compartment, and the another storage compartment 12 may be a freezing compartment. Further, a quick freezing compartment may be provided between the storage compartment 11 and the another storage compartment 12.

The cooling chamber 13 in the embodiments of this invention may be arranged behind the another storage compartment 12. In the embodiments of this invention, the refrigerator 100 further comprises another refrigeration air passage connecting the air outlet of the cooling chamber 13 and the another storage compartment 12, and another return air passage connecting the another storage compartment 12 and the cooling chamber 13. In some alternative embodiments of this invention, both the refrigeration air passage 20 and the return air passage communicate with the another storage compartment 12, namely, the freezing compartment, instead of the cooling chamber 13, so as to utilize the refrigeration output in the cooling chamber.

In some embodiments of this invention, the refrigerator 100 may further comprise a movable air supply hood 83 provided at an outer side of the air outlet of the cooling chamber 13 and configured to provide an opening allowing refrigeration air to flow into the refrigeration air passage 20 when closing the air outlet of the cooling chamber 13. That is, when the movable air supply hood 83 closes the air outlet of the cooling chamber 13, the another refrigeration air passage connected with the another storage compartment 12 can be closed, so that the refrigeration air passage 20 is not blocked.

The refrigerator 100 of the embodiments of this invention may have multiple working modes. As shown in FIGS. 1-3, the arrows in the figures represent the flow directions of air flow. The multiple working modes may comprise the following working modes: an independent working mode of the storage compartment 11, an independent working mode of the another storage compartment 12, a joint working mode and an accurate refrigeration mode. In the independent working mode of the storage compartment 11, the movable air supply hood 83 is closed, the first air door 81 is opened, the second air door 82 is connected with the first branch 22, the second air supply device 60 works while the first air supply device 50 does not work, so that the storage compartment 11 works independently. In the independent working mode of the another storage compartment 12, the movable air supply hood 83 is opened, the first air door 81 is closed, the second air supply device 60 works while the first air supply device 50 does not work, so that the another storage compartment 12 works independently. In the joint working mode, the movable air supply hood 83 is opened, the first air door 81 is opened, the second air door 82 is connected with the first branch 22, the second air supply device 60 works while the first air supply device 50 does not work, so that the two storage compartments 11, 12 work jointly. In the accurate refrigeration mode, the movable air supply hood 83 is closed, the first air door 81 is opened, the second air door 82 is connected with the second branch 23, and both the second air supply device 60 and the first air supply device 50 work, so that accurate refrigeration can be performed in a certain area of the storage compartment 11. To prevent excessive temperature rise in other areas of the storage compartment 11 and in the another storage compartment 12, after the accurate refrigeration mode operates for a certain period, the refrigerator automatically exits from this mode.

Although multiple embodiments of this invention have been illustrated and described in detail, those skilled in the art may make various modifications and variations to the invention based on the content disclosed by this invention or the content derived therefrom without departing from the spirit and scope of the invention. Thus, the scope of this invention should be understood and deemed to include these and other modifications and variations.

What is claimed is:

1. A refrigerator, comprising:

a storage compartment;

a refrigeration air passage configured to supply refrigeration air;

a top air passage provided at a top wall of the storage compartment and connected with the refrigeration air passage to receive refrigeration air therefrom;

an air guiding pipe comprising an air inlet end connected with the top air passage and an air outlet end for supplying air to the storage compartment, wherein the air guiding pipe is bent downwards to the air outlet end after horizontally extending for a predetermined length from the air inlet end to form an air outlet opening downwards; and a first air supply device configured to cause air flow to enter the air guiding pipe via the top air passage, such that the refrigeration air flowing into the top air passage from the refrigeration air passage is blown downwards in a manner of concentratively cooling via the air guiding pipe;

wherein the top air passage, which extends longitudinally, is longitudinally arranged in a corner at the top of the storage compartment, a rear end of the top air passage is formed with an air inlet communicating with the refrigeration air passage, a horizontal portion of the air guiding pipe extends transversely, the refrigeration air passage is arranged at a rear wall of the storage compartment, and comprises at least one first air outlet communicating with the storage compartment and a second air outlet communicating with the top air passage, the refrigeration air passage also comprises a first branch and a second branch, the refrigerator also comprises an air passage switching device configured to controllably close or open the first branch and/or the second branch, the air passage switching device comprising a first air door and a second air door, the at least one first air outlet is provided on the first branch, the second air outlet is provided on the second branch, and the second air door is arranged at the air inlets of the first branch and the second branch to close the second branch when opening the first branch and close the first branch when opening the second branch;

the first air door is arranged at the air inlet of the general refrigeration air passage, the refrigerator further comprises a cooling chamber and a movable air supply hood provided at an outer side of the air outlet of the cooling chamber, the refrigerator has multiple working modes, the multiple working modes comprise the following working modes: an independent working mode of the storage compartment, an independent working mode of the cooling chamber, a joint working mode and an accurate refrigeration mode, in the independent working mode of the storage compartment, the movable air supply hood is closed, the first air door is opened, the second air door is connected with the first branch, the second air supply device works while the first air supply device does not work; in the independent working mode of the another storage compartment, the movable air supply hood is opened, the first air door is closed, the second air supply device works while the first air supply device does not work; in the joint working mode, the movable air supply hood is opened, the first air door is opened, the second air door is connected with the first branch, the second air supply device works while the first air supply device does not work; in the accurate refrigeration mode, the movable air supply hood is closed, the first air door is opened, the second air door is connected with the second branch, and both the second air supply device and the first air supply device work.

2. The refrigerator of claim 1, further comprising: a second air supply device configured to cause the refrigeration air to enter the refrigeration air passage.

3. The refrigerator of claim 1, wherein:

an air inlet of the air inlet end of the air guiding pipe communicates and is connected with an air outlet of the top air passage, and the first air supply device is arranged inside the top air passage and/or the air guiding pipe; or an air inlet of the first air supply device communicates and is connected with the air outlet of the top air passage, and an air outlet of the first air supply device communicates and is connected with the air inlet of the air inlet end of the air guiding pipe.

4. The refrigerator of claim 1, wherein the first air supply device is a centrifugal blower or a centrifugal impeller provided at the air outlet of the top air passage.

5. The refrigerator of claim 1, wherein the first air supply device is configured to suck the refrigeration air entering the top air passage from an upper part of the top air passage, and horizontally blow at least part of the refrigeration air to the air guiding pipe.

6. The refrigerator of claim 1, wherein a front end of the top air passage is formed with an air outlet for supplying air to the air guiding pipe.

7. The refrigerator of claim 1, wherein an air outlet of the air guiding pipe faces a vertical downside direction, and is provided at the transverse center of the storage compartment.

8. The refrigerator of claim 2, wherein:

the refrigeration air passage comprises a general refrigeration air passage, and the first branch and the second branch respectively communicate with the general refrigeration air passage.

* * * * *